United States Patent [19]

Malagisi

[11] 4,053,895

[45] Oct. 11, 1977

[54] ELECTRONICALLY SCANNED MICROSTRIP ANTENNA ARRAY

[75] Inventor: Carmen S. Malagisi, Rome, N.Y.

[73] Assignee: The United States of America as represented by the Secretary of the Air Force, Washington, D.C.

[21] Appl. No.: 744,498

[22] Filed: Nov. 24, 1976

[51] Int. Cl.[2] ..... H01Q 3/26

[52] U.S. Cl. ..... 343/700 MS; 343/854

[58] Field of Search ..... 343/700 MS, 854, 769

[56] References Cited

U.S. PATENT DOCUMENTS

| | | | |
|---|---|---|---|
| 3,665,480 | 5/1972 | Fassett | 343/854 |
| 3,921,177 | 11/1975 | Munson | 343/700 MS |

*Primary Examiner*—Alfred E. Smith
*Assistant Examiner*—David K. Moore
*Attorney, Agent, or Firm*—Joseph E. Rusz; Willard R. Matthews, Jr.

[57] ABSTRACT

A microstrip electronically scannable antenna is realized by means of an array of disc elements that are separated from a common ground plane by a dielectric medium. The center of each disc element is electronically short circuited to the ground plane. At least two pairs of diametrically opposed short circuitry switches (diodes) are connected between certain locations on the peripheral edge of each disc element and the ground plane. The polarization and phase of the reflected energy of each disc element is controlled by certain combinations of open circuited and short circuited pairs of short circuiting switches. Electronic scanning is achieved by control of the short circuitry switches, specifically by digitally controlling the forward and reverse bias of the diodes.

10 Claims, 8 Drawing Figures

FIG. 1
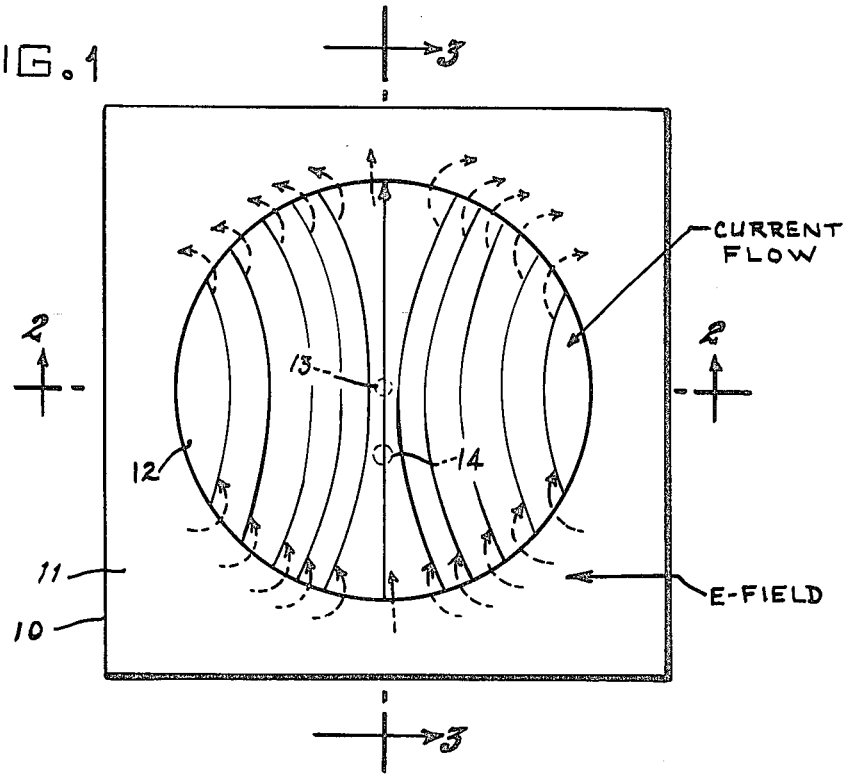
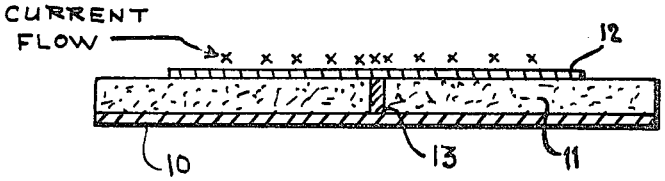
FIG. 2
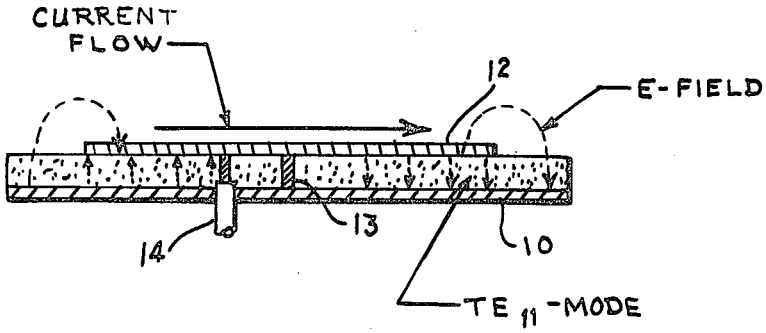
FIG. 3

ELECTRONICALLY SCANNED MICROSTRIP ANTENNA ARRAY

STATEMENT OF GOVERNMENT INTEREST

The invention described herein may be manufactured and used by or for the Government for governmental purposes without the payment of any royalty thereon.

BACKGROUND OF THE INVENTION

This invention relates to antennas, and in particular to electronically scannable microstrip antenna arrays.

Scannable antennas are currently used in many radar and communications systems. It is desirable that the cost and complexity of the antennas be kept to a minimum and that electronic scanning be used to avoid the many mechanical problems encountered in physically rotating the antennas. When such systems are carried by aircraft, satellites or missiles, factors such as weight, physical size and the ability to withstand adverse environmental conditions and severe physical punishment become very important. Conventional electronically scanned antennas with a corporate feed system utilize complex phase shifting networks and are not usually physically suitable to airborne applications. There currently exists, therefore, the need for an electronically scannable antenna array that is inexpensive, simple and adaptable to any type of airborne application. The present invention is directed toward satisfying that need.

SUMMARY OF THE INVENTION

The invention comprehends a microstrip reflect array that is basically an array of disc elements printed on microstrip. Each disc has at least two pairs of short circuiting devices or diodes positioned at diametrically opposite edges of the disc. A forward biased diode is a short and reverse biased diode which is an open circuit. The center of the disc is also shorted to the ground plane of the microstrip. When an incident plane wave that is circularly polarized is directed normal to the disc and ground plane, the reflected plane wave is also circularly polarized but of the same sense when two diametrically opposite diodes are forward biased. By digitally forward and reverse biasing opposite diode pairs, the reflected circularly polarized energy is phase shifted. Two pairs of diodes provide a one bit phase shifter, four pairs provide a two bit phase shifter, eight pairs provide a three bit phase shifter, et cetera. An array of these elements is set on a flat surface and space fed by a circularly polarized element. The circularly polarized feed is positioned at approximately a focus over diameter (F/D) ratio of 0.5. With each element having independent phase control, an electronically scanned array (reflect-array) is achieved, i.e., a beam is formed in space by co-phasing the reflected energy from each element to a given direction. This directive beam is then scannable over a 120° conical space sector centered to the normal of the flat surface of the array.

It is a principal object of the invention to provide a new and improved electronically scanned microstrip antenna reflect-array.

It is another object of the invention to provide an electronically scanned antenna array that is simple and inexpensive and suitable for all types of airborne applications.

It is another object of the invention to provide an electronically scanned antenna that has low insertion loss and that is designable for all RF frequencies.

These, together with other objects, features and advantages of the invention, will become more readily apparent from the following detailed description when taken in conjunction with the illustrative embodiment in the accompanying drawings.

DESCRIPTION OF THE DRAWINGS

FIG. 1 is a plan view of a microstrip disc element illustrating electromagnetic fields and current flow characteristics;

FIG. 2 is a sectional view of FIG. 1 taken at 2—2;

FIG. 3 is a sectional view of FIG. 1 taken at 3—3;

DETAILED DESCRIPTION OF THE PREFERRED EMBODIMENT

Figure 7:
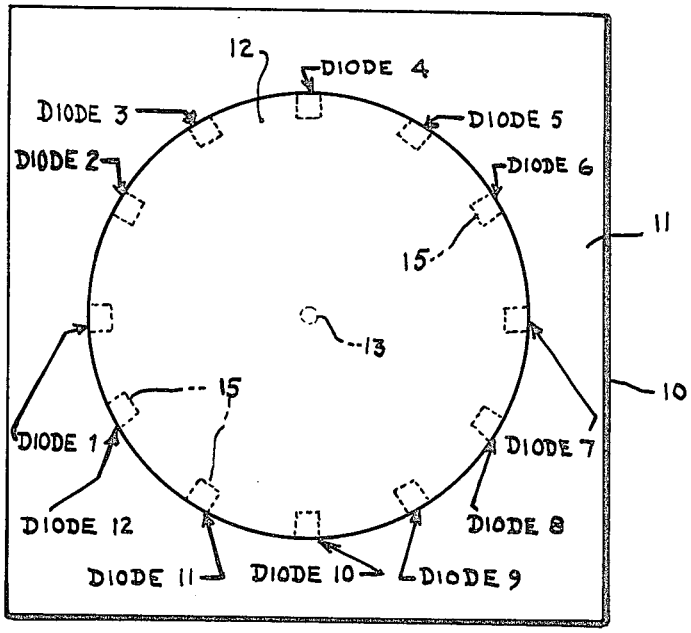
FIG. 7 is a plan view of an antenna disc element incorporating the principles of the invention having six pair of short circuitry diodes.
Figure 8:
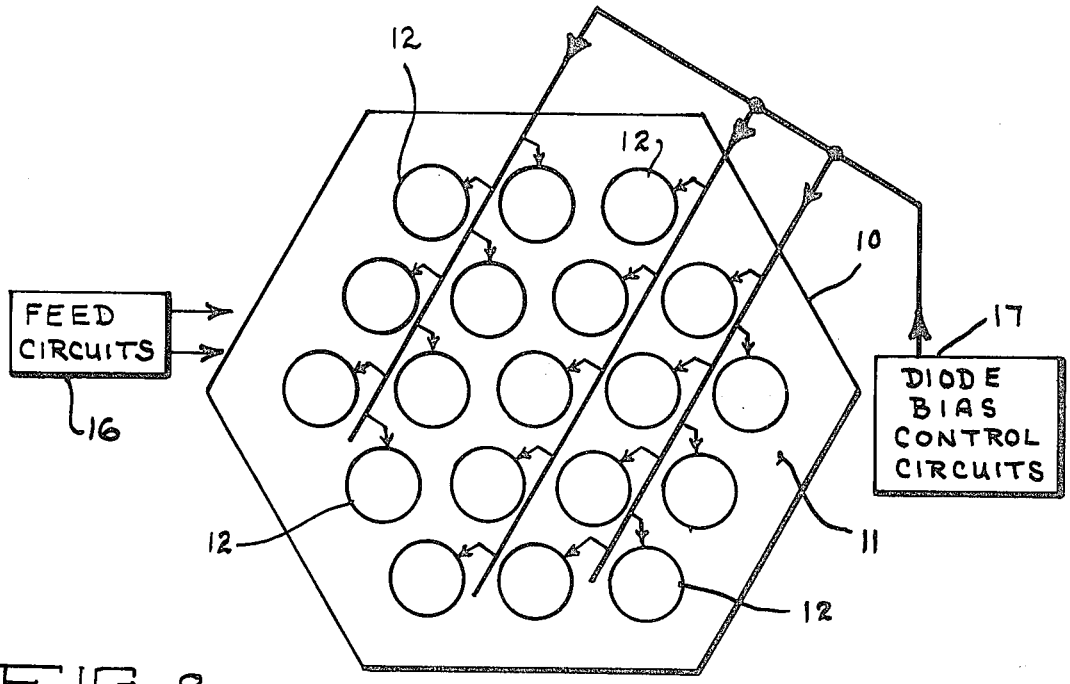
FIG. 8 is a plan view of one presently preferred embodiment of the electronically scanned microstrip antenna array comprehended by the invention.

The electronically scanned microstrip antenna array of the invention is illustrated by FIG. 8. Structural individual disc elements are shown in FIGS. 1 through 7. FIGS. 1 through 3 illustrate the disc element as an active element fed directly by 14. FIGS. 4 through 7 illustrate different embodiments of the invention that provide phase shifting for the passive disc element in different increments. Having reference to FIGS. 1 through 7, an individual antenna element comprises a metallic disc member 12, metallic ground plane member 10, and dielectric medium 11. The antenna elements either singly or in array can conveniently be fabricated by properly etching one side of a printed circuit board using conventional microcircuit techniques. The center of each disc member 12 is short circuited to ground plane member 10 by an electrically conductive connector 13. The disc members 12 are fed spacially by feed 16 in FIG. 8. Short circuiting switches such as diodes 15 are connected in diametrically opposed pairs between the peripheral edge of disc member 12 and ground plane member 10 at appropriate locations determined by the embodiment chosen. The antenna elements described above can be arrayed as illustrated in FIG. 8 and can of course utilize a single ground plane element. Short circuit switching action is accomplished by forward and reverse biasing the diodes with conventional digitally controlled diode bias control circuits 17. The array is spacially fed circularly polarized RF energy from feed 16 in a conventional manner.

The circular microstrip element described above is essentially a circular cavity with a $TE_{11}$ mode. It is composed of the circular disc 12 which is approximately 0.90 wavelength in circumference and less than one-tenth wavelength above ground plane 10. The center of the disc is shorted to the ground plane to force the $TE_{11}$ mode. This element can be fed by putting a source between the disc and ground plane anywhere along a radius greater than zero and less than the full radius. The position will depend on the impedance desired. Lower impedances would be at radial distances that are small, or close to the center, and high impedances will be with the source at radial distances that are large, or close to the edge. An element fed in either of these ways will produce a linear polarized field (see FIG. 1). Circular polarization can be obtained by feeding the element with two sources 90° out of phase and physically placed 90° from each other on the disc. This is explained in the publication entitled "Microstrip Antennas," by J. Q. Howell, in IEEE Transactions on Antennas Propagation, January 1975, page 90.

If the element is constructed with no sources, i.e., with only the center shorted, then when excited by a linear field, it will reflect or reradiate a linear field. When the element is shorted at opposite ends of the disc, i.e., at the circumference but diametrically opposite each other, and the linear field exciting the disc is in line with the shorts on the circumference of the disc, the reradiated field will be 180° out of phase with the previous open circuited case.

When the open circuit disc is excited by a circularly polarized field, it will reradiate a circularly polarized field of opposite sense. If the disc is turned about the axial direction no RF phase shift will occur. However, when the disc is shorted at opposite sides, then excited by a circularly polarized field, the reradiated field will also be circular but of the same sense. If the disc is now rotated about the axial direction, there will be a phase shift as a function of rotation, i.e., twice the degree phase shift per degree of rotation.

If diodes were placed about the periphery of the disc and biased accodingly to cause short circuits and open circuits along the circumference, then the electronic phase shifter/element can be used in reflect array mode. The following number of diodes or shorting positions will produce the following phase shifts.

| | | | | |
|---|---|---|---|---|
| 4 | diodes/positions | | 180 | degree increments |
| 6 | diodes/positions | | 120 | " |
| 8 | diodes/positions | | 90 | " |
| | | and | 45 | " |
| 10 | diodes/positions | | 72 | " |
| | | and | 36 | " |
| 12 | " | | 60 | " |
| | | and | 30 | " |
| 14 | " | and | 51 | " |
| | | and | 25.5 | " |
| 16 | " | | 45 | " |
| | | and | 22.5 | " |
| 18 | " | | 40 | " |
| | | AND | 20 | " |
| 20 | " | | 36 | " |
| | | AND | 18 | " |
| N | " | | 720/N | " |
| | | AND | 360/N | " |

when N is equal to or greater than 8.

These elements can be arranged in an array as illustrated by FIG. 8 and excited by a circularly polarized feed. Each element can be phase controlled to cause the collimation of the beam in any desired direction and scannable over the hemisphere within the limits of normal array theory. The elements should be arrayed in a reflectarray configuration with a distance from center to center of 0.625 to 0.750 wavelength.

The design parameter of the disc in a microstrip configuration for the reflectarray element is the same as stated in the above referenced article by J. G. Howell for an active element.

Where:

$$f = \frac{1.841\, c}{2\, a\, (\epsilon_r)^{\frac{1}{2}}}$$

$f$ = resonant frequency
$c$ = velocity of light in free space
$a$ = radius of disc
$^{e}r$=dielectric constant.

Figure 4:
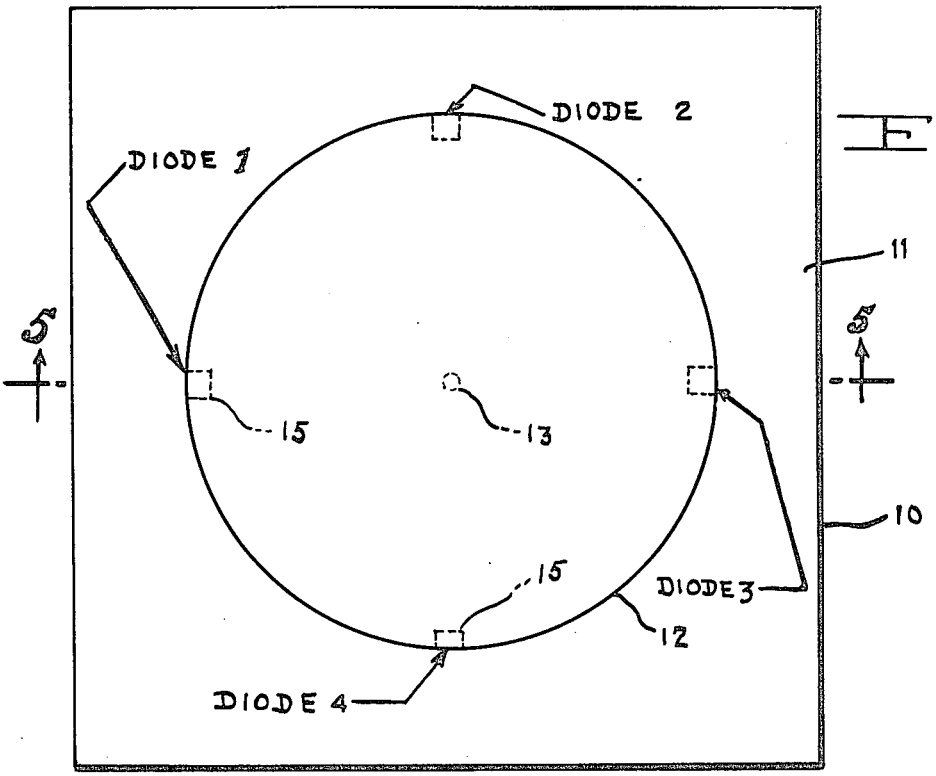
FIG. 4 is a plan view of an antenna disc element incorporating the principles of the invention having two pairs of short circuitry diodes.
Figure 5:
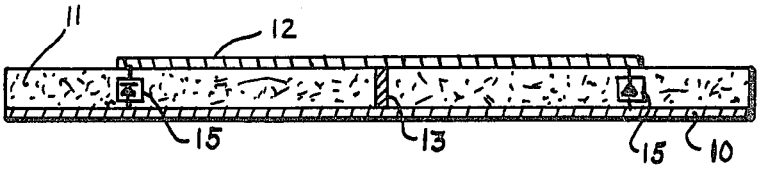
FIG. 5 is a sectional view of FIG. 4 taken at 5—5.

A one-bit phase shifter/element for reflectarray is a disc element with four diodes equally spaced about the circumference of the disc as shown in FIG. 5. When diodes 1 and 3 are forward biased (short circuit) and diodes 2 and 4 are reversed biased (open circuit) there is a reflected circularly polarized field of the same sense circularly polarized as incident on the element. When diodes 1 and 3 are reversed biased and diodes 2 and 4 are forward biased, the reflected circularly polarized field is still the same sense circular polarized as incident on the element but shifted 180° the previous state, i.e.

| | reflected phase | |
|---|---|---|
| | 0° | 180° |
| Diodes | | |
| 1 and 3 | F | R |
| 2 and 4 | R | F |

F = forward biased (short circuit)
R = reversed biased (open circuit)

Figure 6:
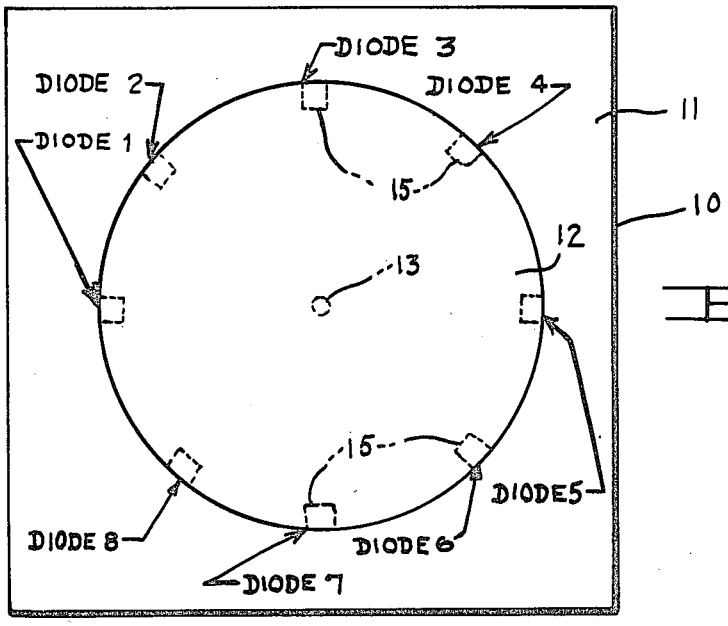
FIG. 6 is a plan view of an antenna disc element incorporating the principles of the invention having four pairs of short circuitry diodes.

FIG. 6 shows a disc element with eight diodes equally spaced about the circumference of the disc element. The following phase states are obtained in a reflectarray mode with appropriate forward and reverse biasing of diodes.

| | Phase Shift | | | | | | | |
|---|---|---|---|---|---|---|---|---|
| Diode Pairs | 0 | 45° | 90° | 135° | 180° | 225° | 270° | 315° |
| 1 AND 5 | F | F | R | R | R | R | R | F |
| 2 AND 6 | R | F | F | F | R | R | R | R |
| 3 AND 7 | R | R | R | F | F | F | R | R |
| 4 AND 8 | R | R | R | R | R | F | F | F |

FIG. 7 shows a disc element with twelve diodes equally spaced about the circumference of the disc element. The following phase states are obtained in a reflectarray mode with appropriate forward and reverse biasing of diodes.

| | 0 | 30 | 60 | 90 | 120 | 150 | 180 | 210 | 240 | 270 | 300 | 330 |
|---|---|---|---|---|---|---|---|---|---|---|---|---|
| Diode Pairs | | | | | | | | | | | | |
| 1 and 7 | F | F | R | R | R | R | R | R | R | R | R | F |
| 2 and 8 | R | F | F | F | R | R | R | R | R | R | R | R |
| 3 and 9 | R | R | R | F | F | F | R | R | R | R | R | R |
| 4 and 10 | R | R | R | R | R | F | F | F | R | F | R | R |
| 5 and 11 | R | R | R | R | R | R | R | F | F | F | R | R |
| 6 and 12 | R | R | R | R | R | R | R | R | R | F | F | F |

Although the present invention has been described with reference to specific embodiments, it is not intended that the same be taken in a limiting sense. Accordingly, it is understood that the scope of the invention in its broader aspects is to be defined by the appended claims and no limitation is to be inferred from definitive language used in describing the preferred embodiments.

What is claimed is:

1. An antenna element comprising:

a metallic disc in juxtaposition with a metallic ground plane member and separated therefrom by a dielectric medium, an electrical short circuit connecting the center of said metallic disc and said ground plane member, at least two pairs of diametrically opposed short circuiting switches connected between the edge of said disc and said ground plane member, and a phase control circuit for actuating said short circuiting switches.

2. An antenna element as defined in claim 1 including means for coupling RF energy to said metallic disc.

3. An antenna element as defined in claim 1 including means for coupling circularly polarized RF energy to said metallic disc.

4. An antenna element as defined in claim 3 wherein said pairs of short circuiting switches comprise four diodes positioned around the periphery of said disc at 90° increments, and said phase control circuit comprises means for selectively controlling the forward and reverse bias applied to discrete pairs of diodes.

5. An antenna element as defined in claim 4 wherein said pairs of short circuiting switches comprise eight diodes positioned around the periphery of said disc at 45° increments.

6. An antenna element as defined in claim 4 wherein said pairs of short circuiting switches comprise twelve diodes positioned around the periphery of said disc at 30° increments.

7. An antenna element as defined in claim 4 wherein said pairs of short circuiting switches comprise N diodes positioned around the periphery of said disc at 360°/N increments, N being an even integer.

8. An electronically scanned antenna array comprising a multiplicity of metallic discs in juxtaposition with a metallic ground plane member and separated therefrom by a dielectric medium, an electrical short circuit connecting the center of each metallic disc and said ground plane member, at least two pairs of diametrically opposed short circuiting switches connected between the edge of each said disc and said ground plane member, a phase control circuit for activating said short circuiting switches, and means for coupling RF energy to said metallic discs.

9. An electronically scanned antenna array as defined in claim 8 wherein for each said disc said pairs of short circuiting switches comprise N diodes positioned around the periphery of said disc at 360°/N increments, N being an even integer, and said phase control circuit comprises means for selectively controlling the forward and reverse bias applied to discrete pairs of diodes.

10. An electronically scanned antenna array as defined in claim 9 wherein said discs, dielectric medium and metallic ground plane are fabricated of microstrip.

* * * * *